US011081775B2

(12) United States Patent
Reveles-Wilson et al.

(10) Patent No.: US 11,081,775 B2
(45) Date of Patent: Aug. 3, 2021

(54) ACTUATING SUPPORT MEMBER

(71) Applicant: OXFORD SPACE SYSTEMS LIMITED, Didcot (GB)

(72) Inventors: Juan Reveles-Wilson, Abingdon (GB); Vincent Fraux, Didcot (GB); Martin Humphries, Bristol (GB)

(73) Assignee: OXFORD SPACE SYSTEMS LIMITED, Didcot (GB)

( * ) Notice: Subject to any disclaimer, the term of this patent is extended or adjusted under 35 U.S.C. 154(b) by 35 days.

(21) Appl. No.: 16/480,197

(22) PCT Filed: Jan. 30, 2018

(86) PCT No.: PCT/GB2018/050257
§ 371 (c)(1),
(2) Date: Jul. 23, 2019

(87) PCT Pub. No.: WO2018/142116
PCT Pub. Date: Aug. 9, 2018

(65) Prior Publication Data

US 2020/0006838 A1 Jan. 2, 2020

(30) Foreign Application Priority Data

Jan. 31, 2017 (GB) ..... 1701568

(51) Int. Cl.
*H01Q 1/12* (2006.01)
*H01Q 15/16* (2006.01)

(52) U.S. Cl.
CPC ..... *H01Q 1/1235* (2013.01); *H01Q 15/161* (2013.01)

(58) Field of Classification Search
CPC .... H01Q 1/1235; H01Q 1/288; H01Q 15/161; H01Q 1/1213; H01Q 19/132; F24S 23/715; F24S 25/13
See application file for complete search history.

(56) References Cited

U.S. PATENT DOCUMENTS 3,680,571 A 8/1972 Houston
4,667,451 A 5/1987 Onoda
(Continued)

FOREIGN PATENT DOCUMENTS

CN 2630395 Y 8/2004
CN 1580469 A 2/2005
(Continued)

OTHER PUBLICATIONS

Notification of Transmittal of the International Search Report and the Written Opinion of the International Searching Authority, International Search Report, and Written Opinion for International Application No. PCT/GB2018/050257 (Forms PCT/ISA/220, PCT/ISA/210, and PCT/ISA/237), dated Apr. 26, 2018, 22 pages.
(Continued)

*Primary Examiner* — Haissa Philogene
(74) *Attorney, Agent, or Firm* — Withrow & Terranova, P.L.L.C.; Vincent K. Gustafson

(57) ABSTRACT

A deployable structure includes a plurality of interconnected elongated support members, deployed from a stowed state to an expanded state in which the support members are arranged in a ring. Each support member is provided with a connector (28) for longitudinal movement during deployment with respect to the support member. An actuating support member (27) has a drive member (50) for longitudinal movement with respect to the actuating support member, and an electromagnetic device arranged to drive the drive member in one direction with respect to the actuating support member. The drive member is connected to the connector by a lost motion connector, thus the connector is capable of moving in said one direction even if the drive member is not moved by the electromechanical device.

15 Claims, 4 Drawing Sheets

(56) References Cited

U.S. PATENT DOCUMENTS

| | | | | |
|---|---|---|---|---|
| 5,213,122 | A | 5/1993 | Grady, II | |
| 5,680,145 | A * | 10/1997 | Thomson | F24S 23/715 343/915 |
| 5,787,671 | A | 8/1998 | Meguro et al. | |
| 6,313,811 | B1 * | 11/2001 | Harless | B64G 1/222 343/912 |
| 8,922,456 | B2 * | 12/2014 | Tabata | H01Q 1/288 343/915 |
| 9,660,351 | B2 * | 5/2017 | Medzmariashvili | H01Q 1/1235 |
| 10,170,843 | B2 * | 1/2019 | Thomson | H01Q 1/288 |
| 2004/0055627 | A1 | 3/2004 | Moga | |
| 2005/0166950 | A1 | 8/2005 | Grady, II | |
| 2015/0060605 | A1 | 3/2015 | Tserodze et al. | |

FOREIGN PATENT DOCUMENTS

| | | | |
|---|---|---|---|
| CN | 201185708 | Y | 1/2009 |
| CN | 102296655 | A | 12/2011 |
| CN | 102623787 | A | 8/2012 |
| CN | 203290367 | U | 11/2013 |
| CN | 103794842 | A | 5/2014 |
| CN | 204260003 | U | 4/2015 |
| CN | 105071012 | A | 11/2015 |
| JP | H08103314 | A | 4/1996 |
| JP | H11247290 | A | 9/1999 |
| KR | 100844266 | B1 | 7/2008 |
| WO | 9531913 | A1 | 11/1995 |
| WO | 2012065619 | A1 | 5/2012 |

OTHER PUBLICATIONS

Search Report under Section 17(5) for United Kingdom Patent Application No. GB1701568.6, dated Jun. 7, 2017, 5 pages.

Fraux, V. et al., "Novel large deployable antenna backing structure concepts for foldable reflectors," CEAS Space Journal, Aug. 10, 2013, Springer, 7 pages.

Oxford Space Systems, "Deployment & Stowage of 4 metre Diameter Reflector Antenna Breadboard," YouTube video [online]. Mar. 22, 2014 [retrieved on Jul. 26, 2019]. Retrieved from the Internet: <URL: https://youtu.be/APSsrPbh_X4>. Screen capture sequence, 13 pages.

First Office Action for Chinese Patent Application No. 201880006442.3 dated Aug. 24, 2020, 31 pages including English translation.

* cited by examiner

ACTUATING SUPPORT MEMBER

This application is a 35 U.S.C. § 371 national phase filing of International Application No. PCT/GB2018/050257 filed on Jan. 30, 2018, and claims the benefit of United Kingdom Patent Application No. 1701568.6 filed on Jan. 31, 2017, wherein the contents of the foregoing applications are hereby incorporated by reference herein in their respective entireties.

BACKGROUND OF THE INVENTION

1. Field of the Invention

This invention relates to an actuating support member for a (e.g. reflector antenna) deployable structure, which is used to actuate the deployable structure from a stowed state to a deployed state in which the structure defines a ring. In particular the invention relates to a linear actuator and a support member for a deployable structure. Once deployed, the actuating support member may act as a supporting strut, e.g., for an elastic membrane.

2. Description of the Related Art

In particular, but not exclusively, the (e.g. reflector) deployed structure can be used to support a surface. The surface may be defined by a material that is flexible so that it can be stored in a compact state when the structure is in the stowed state, and form an expanded structure, such as part or whole of a (e.g. paraboloid) dish, when the structure is deployed. Such a dish can be used as a reflector antenna. Typically such dishes are used in space applications, where the dish needs to be stored in a compact state when a platform (e.g. a satellite) is being launched, but the dish can later be deployed to a large size, having for example a diameter from 2 metres to 50 metres or more.

One such deployable structure is disclosed in WO 2012/065619. This discloses a polyhedral truss formed of a number of facets, each of which is formed of a six bar linkage. A number of the trusses are connected together, and a membrane or mesh is mounted on the surfaces of the trusses to form a radio frequency (RF) performing reflective surface. A drawback of this system is that a synchronisation mechanism or synchronised actuation systems would be required to deploy the facets. This adds to the complexity and weight of the structure.

SUMMARY OF THE INVENTION

Viewed from one aspect, the invention provides an actuating support member for use in a deployable structure which comprises a plurality of interconnected elongate support members, the structure being deployable from a stowed state to a deployed, expanded, state in which the support members are arranged in a ring; each support member being provided with a connector mounted on the support member for longitudinal movement with respect to the support member when the structure is being changed between the stowed state and the expanded state;

wherein the actuating support member comprises a drive member mounted for longitudinal movement with respect to the actuating support member, and an electromechanical device arranged to drive the drive member in one direction with respect to the actuating support member; the drive member being connected to the connector by a lost motion connection so that the drive member causes the connector to move in said one direction when the drive member is moved by the electromechanical device in said one direction, and the connector is capable of moving in said one direction even if the drive member is not moved by the electromechanical device.

The present invention provides an actuating support member for actuating a deployable structure from its stowed state to its deployed state. The actuating support member will typically form one of the plurality of support members that make up the deployable structure. The actuating support member includes a drive member that is connected to a connector mounted on the actuating support member by a lost motion connection. This means that although the drive member is capable of causing the connector to move in one direction (e.g. along the actuating support member, when actuating the deployable structure from its stowed state to its deployed state, towards a first end of the actuating support member (from a second end of the actuating support member)) when the drive member is moved by an electromechanical device (e.g. a (drive) motor), the connector is also capable of moving in this direction (from the second end to the first end) even when the drive member is not moved by the electromechanical device.

Thus, if the electromechanical device fails or there is another problem with moving the drive member of the actuating support member (from the second end to the first end, to deploy the deployable structure), the connector in the lost motion connection can detach from the electromechanical device (e.g. a drive motor) at the point of failure whereupon a drive (e.g. actuating) member (driving the deployment of the structure) becomes driven, e.g. by another actuating support member in the deployable structure. The lost motion connection in the failed actuating support member will thus permit movement of the connector on that support member, i.e. after the drive member has failed and stopped actuating the connector. Other scenarios such as a large imbalance of displacements between drive members can also lead to a detachment of the connector in the drive member which lags behind, e.g. when a deployable structure comprises a plurality of actuating support members. The lost motion connection thus enables the deployable structure to be deployed, even when a drive member stops moving (i.e. is not moved by the electromechanical device).

In some embodiments, the actuating support member which is provided with a drive mechanism (e.g. comprising the drive member and the electromechanical device arranged to drive the drive member) comprises a hollow portion. In some embodiments, the electromechanical device is contained within the hollow portion of the actuating support member. In some embodiments, the electromechanical device rotates an elongate drive shaft extending longitudinally inside the actuating support member. In some embodiments, the drive shaft is in the form of a lead screw which engages in a threaded portion of the drive member, so that rotation of the lead screw cause longitudinal movement of the drive member. In some embodiments the drive member has a body portion which is inside the actuating support member.

In some embodiments the lost motion connection between the drive member and the connector is provided by a portion of the drive member abutting against (but, e.g., not fixedly connected to) a portion of the connector, so that movement of the drive member towards the first end of the actuating support member (e.g. away from a second end of the actuating support member) pushes the connector in the same direction. However if the drive mechanism fails the first connector is still free to move towards the first end of the actuating support member, e.g. the drive member and the connector are arranged to detach from each other. Preferably the drive member and the connector are separate (components) from each other.

Thus preferably the connector is able to be separated from the drive member at any (e.g. at each and every) point along the length of travel of the drive member when the deployable structure is being deployed from its stowed state to its deployed state, e.g. whenever the drive member is not moved in the one direction by the electromechanical device.

In some embodiments, at least a body portion of the connector is mounted on the outside of the actuating support member (and, e.g., is separable from at least a portion of the drive member inside the actuating support member). In some embodiments, at least part of the outer surface of the actuating support member serves as a bearing surface for the connector.

In the embodiments in which the main body of the connector is mounted on the outside of a hollow portion of the actuating support member that is provided with a drive mechanism, and the main body of the drive member is within the hollow portion of the actuating support member, there is a need for the drive member and the connector to be engaged (but, e.g., not fixedly connected together, e.g. separable from each other). In some embodiments, an actuating support member which is provided with a drive mechanism has a longitudinally extending slot so that a connection can be established between the drive member and the connector.

In some embodiments, a projection of the drive member extends through the slot to engage a portion of the first connector. In some embodiment, there is a plurality of slots. In some embodiments there is a plurality of projections of the drive member, e.g. one for each slot. In some embodiments there are two diametrically opposed slots and there are two diametrically opposed projections on the drive member. It will be appreciated that it would be possible to have an alternative arrangement in which the connector has a portion which extends through a slot in the actuating support member, and is engaged by a portion of the drive member inside the actuating support member In some embodiments an actuating support member which is provided with a drive mechanism, is in the form of a tube in which the or each longitudinal slot is provided. In other embodiments, the actuating support member is fabricated from a plurality of elongate members, e.g. arranged parallel to each other. In some embodiments, a first plurality of elongate members define a first side of the actuating support member and a second plurality of elongate members define a second side of the actuating support member, the first and second sides being displaced laterally so that there are diametrically opposed slots defined between the two sides of the actuating support member.

The invention also extends to a deployable structure which comprises a plurality of interconnected elongate support members, the structure being deployable from a stowed state to a deployed, expanded, state in which the support members are arranged in a ring; each support member being provided with a connector mounted on the support member for longitudinal movement with respect to the support member when the structure is being changed between the stowed state and the expanded state;

wherein at least one of the support members comprises an actuating support member in accordance with any aspect of the present invention to deploy the deployable structure from its stowed state to its deployed state.

Preferably the deployable structure comprises a plurality of actuating support members in accordance with any aspect of the present invention, e.g. such that if one of the actuating support members fails, one (or more) of the other actuating support members are still capable of operating to deploy the deployable structure (with the lost motion connection operating so that the deployable structure is still able to be deployed). Thus preferably, if one of the drive members remains stationary (e.g. when one of the plurality of actuating support members fails), at least one of the other actuating support members is capable of operating to deploy the deployable structure owing to the lost motion connection between the connector and the stationary drive member (of the failed actuating support member). Thus preferably the at least one of the other actuating support members is arranged to actuate the connector (of the failed actuating support member, associated with the stationary drive member) in said one direction even if the stationary drive member (of the failed actuating support member) is not moved by the electromechanical device (of the failed actuating support member).

With the support members connected together in a ring, in some embodiments it is not necessary for each support member to comprise an actuating support member (i.e. to be provided with a drive mechanism), as movement of the connector on a support member which is not provided with a drive mechanism will be effected as a result of the connection of the support members together in the manner described, so that the driving force is provided by the drive mechanism of another support member (i.e. of an actuating support member). It would be possible for each support member to be provided with a drive mechanism (i.e. to each comprise an actuating support member), but reducing the number of drive mechanisms will reduce the mass of the apparatus.

The use of a plurality of drive mechanisms means that if there is failure of one drive mechanism, the structure can still be deployed. If one drive mechanism should fail, the lost motion connection between the movable support member and the drive member of that support member means that the connector can still move freely, so that the structure can be deployed.

The ring in which the support members are connected together may be any suitable and desired closed chain. For example, the ring may form any suitable and desired shape, e.g. circular, elliptical, circular-faceted or elliptical-faceted (e.g. polygonal).

The invention also extends to a deployable structure as described above, in combination with a flexible element which extends across the structure when the structure is deployed. Such a flexible element may be in the form of a mesh, a membrane and/or a cable network structure. The flexible element may be stretched across the structure. The combination of the structure and the flexible element may provide a deployable structure suitable for use as a reflector or an antenna, or a deployable structure suitable for use as part of a reflector or part of an antenna.

The invention also extends to a deployable structure as described above, in combination with a plurality of like structures (e.g. sub-structures), so as to provide a deployable structure suitable for use as a reflector or an antenna, or a deployable structure suitable for use as part of a reflector or part of an antenna. Each sub-structure may be provided with a flexible element which is stretched across the sub-structure when the structure is deployed. Such a flexible element may be in the form of a mesh or a membrane. Alternatively, a single flexible element may be provided which is stretched across the complete structure when deployed.

Viewed from another aspect, the invention provides an actuating support member for use in a deployable structure which comprises a plurality of interconnected elongate support members, the structure being deployable from a stowed state to a deployed, expanded, state in which the support members are arranged in a ring; each support member being provided with a connector mounted on the support member for longitudinal movement with respect to the support member when the structure is being changed between the stowed state and the expanded state; wherein the actuating support member comprises a hollow portion, and said connector is mounted on the exterior of the actuating support member for longitudinal movement with respect to the actuating support member when the structure is being changed between the stowed state and the expanded state;

the actuating support member is provided with two longitudinally extending slots which provide communication between the interior of the actuating support member and the exterior of the actuating support member;

an electromechanical device is mounted in the interior of the actuating support member and is connected to turn a drive shaft which extends longitudinally in the interior of the actuating support member;

the drive shaft is connected to a drive member provided in the interior of the actuating support member, so that rotation of the drive shaft causes longitudinal movement of the drive member within the actuating support member;

connecting portions extend through the slots to provide a lost motion connection between the drive member and the connector, such that movement of the drive member in one direction with respect to the actuating support member urges the connector in said one direction, and movement of the connector in said one direction can be effected even if the drive member remains stationary.

It will be appreciated that this aspect of the invention may (and preferably does) comprise one or more (or all) of the optional and preferable features outlined herein.

In some embodiments, the connecting portions are parts of the drive member, which pass through the slots and engage the connector.

The actuating support member may be incorporated with other support members in a structure as described earlier. In some embodiments at least one other actuating support member is incorporated in the structure. Thus, if the electromechanical device (e.g. motor) fails or there is another problem with moving the drive member of one of the actuating support members, the or each other actuating support member may continue to cause deployment of the structure. The lost motion connection in the failed actuating support member will permit movement of the connector on that support member.

In addition to the support members which are provided with actuating mechanisms, the other support members may be hollow to reduce the mass of the support members. The materials used in the construction of the deployable structure may be strong and light. For example, the materials used may include carbon fibre reinforced plastics and/or light metal alloys.

BRIEF DESCRIPTION OF THE DRAWINGS

Some embodiments of the invention will now be described in more detail, by way of example only, and with reference to the accompanying drawings, in which.

DETAILED DESCRIPTION OF THE PREFERRED EMBODIMENTS

Figure 1:
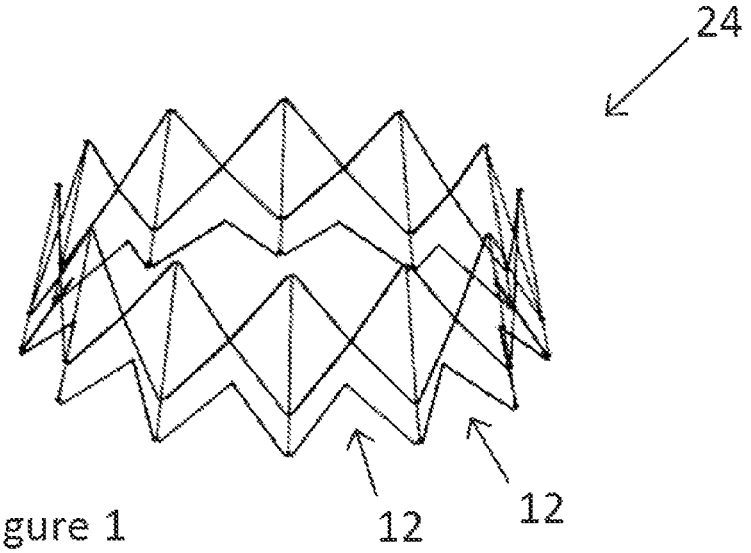
FIG. 1 shows in diagrammatic form a structure comprising a ring formed of a plurality of sub-structure modules.

FIG. 1 shows a plurality of sub-structure modules 12 that are connected in a ring 24 of pyramidal form. A common support member is shared between adjacent modules.

Figure 4:
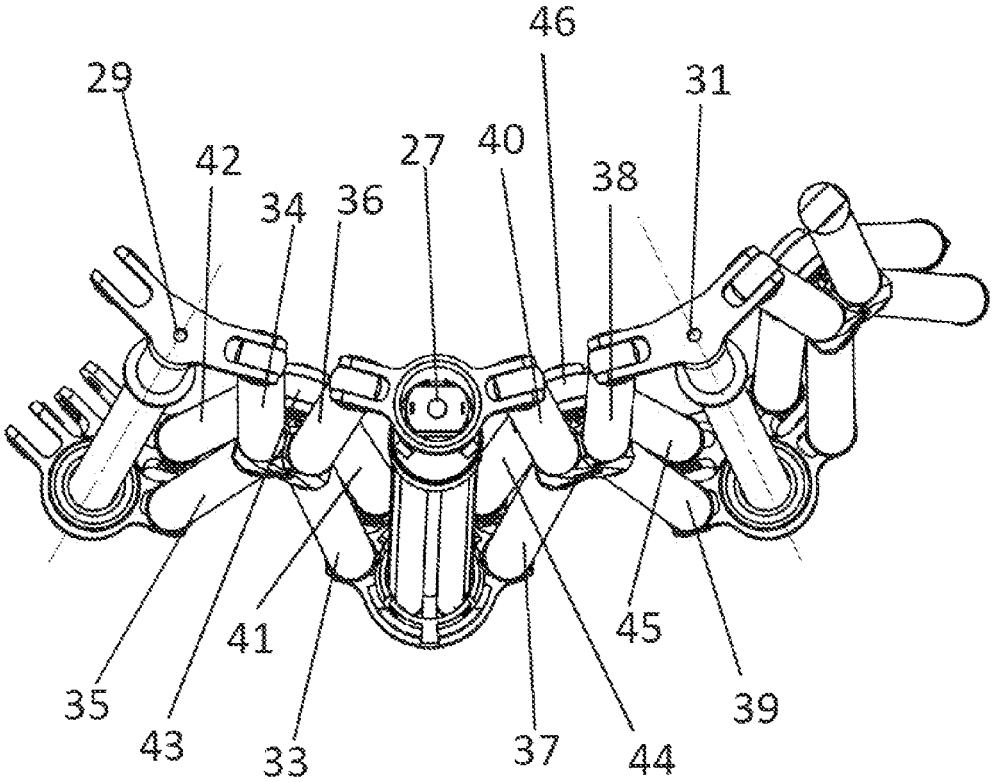
FIG. 4 is a top view of the assembly of FIG. 2.
Figure 2:
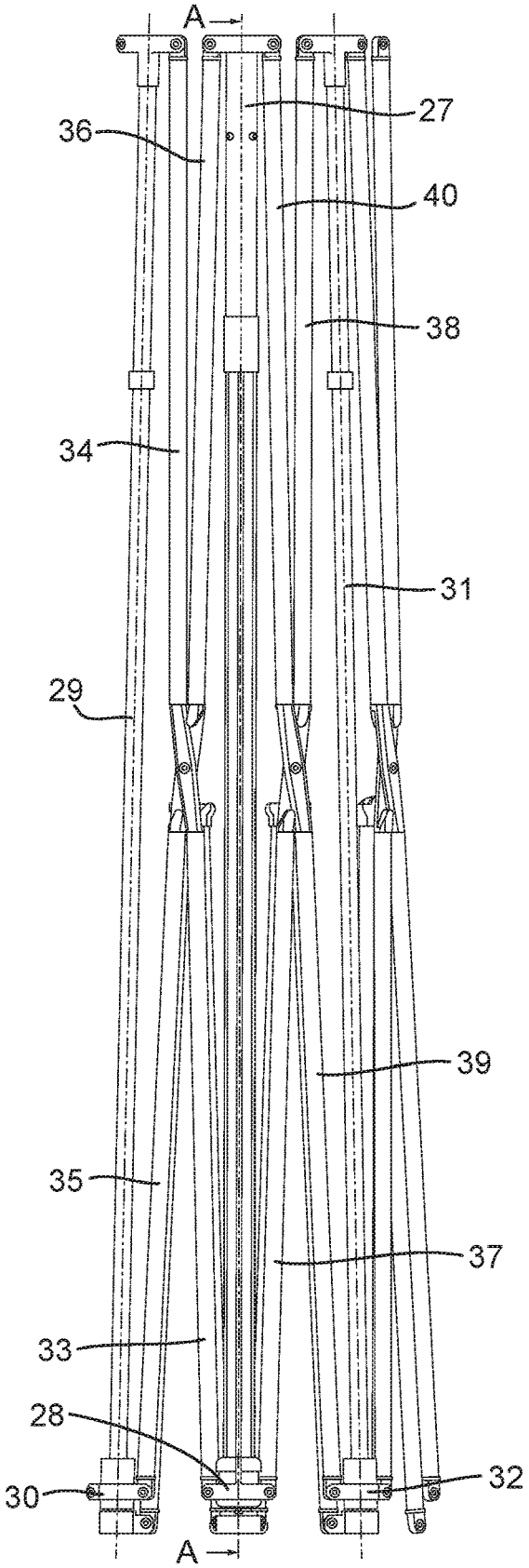
FIG. 2 shows an assembly of three support members of a structure in accordance with the invention, connected together.
Figure 3:
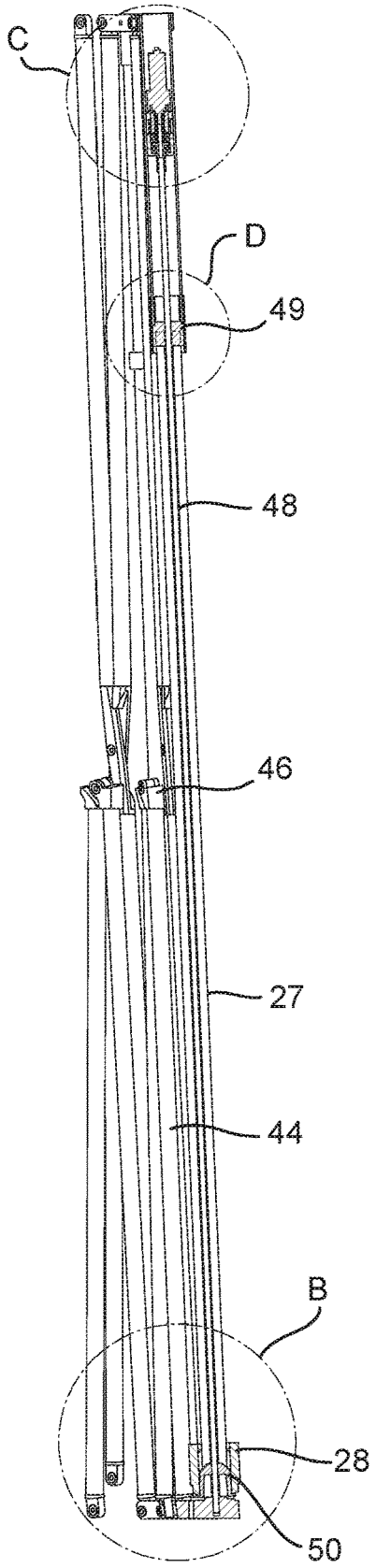
FIG. 3 is a cross section on the line A-A of FIG. 2.

FIGS. 2, 3 and 4 shows in more detail how the support members of a structure are connected together and how a drive mechanism is provided to deploy the structure.

A first elongate support member 27 is provided with an externally mounted collar 28 which is slidably mounted on the support member. On one side of the first support member 27 is a second elongate support member 29 on which is provided an externally mounted collar 30 which is slidably mounted on the support member. On the other side of the first support member 27 is a third elongate support member 31 on which is provided an externally mounted collar 32 which is slidably mounted on the support member. The first support member 27 is provided with a drive mechanism as described later, to urge the collar 28 along the support member as to deploy the arrangement from the state shown in FIG. 2. The second and third support members are passive and are not provided with drive mechanisms. The collars 30 and 32 move when the collar 28 moves, as a result of the linkages provided.

The collar 28 is connected pivotally to the first leg 33 of a first element of a scissor mechanism, and a second leg 34 of the first element of the scissor mechanism is pivotally connected to the upper end of the second support member 29. The first and second legs 33, 34 of the first element of the scissor mechanism are angled with respect to each other and are of equal length. In a similar manner, the collar 30 is connected pivotally to the first leg 35 of a second element of the scissor mechanism, and a second leg 36 of the second element of the scissor mechanism is pivotally connected to the upper end of the first support member 27. The first and second legs 35, 36 of the second element of the scissor mechanism are angled with respect to each other by the same angle as the legs of the first element. The legs 35 and 36 are of equal lengths to each other and to the legs 33 and 34 of the first element of the scissor mechanism.

The collar 28 is also connected pivotally to the first leg 37 of a first element of a second scissor mechanism, and a second leg 38 of the first element of the second scissor mechanism is pivotally connected to the upper end of the third support member 31. The first and second legs 37, 38 of the first element of the second scissor mechanism are angled with respect to each other and are of equal length. In a similar manner, the collar 32 is connected pivotally to the first leg 39 of a second element of the second scissor mechanism, and a second leg 40 of the second element of the second scissor mechanism is pivotally connected to the upper end of the first support member 27. The first and second legs 39, 40 of the second element of the second scissor mechanism are angled with respect to each other by the same angle as the legs of the first element. The legs 39 and 40 are of equal lengths to each other and to the legs 37 and 38 of the first element of the scissor mechanism.

The first and second support members 27, 29 are also connected by a first link member 41 pivotally connected to the bottom of the first support member 27 and a second link member 42 pivotally connected to the bottom of the second support member 29, the two link members 41, 42 being pivotally connected at 43. The first and third support members 27, 31 are also connected by a third link member 44 pivotally connected to the bottom of the first support member 27 and a fourth link member 45 pivotally connected to the bottom of the third support member 31, the two link members 44, 45 being pivotally connected at 46.

As shown in FIG. 3, the first support member 27 is hollow. Inside the first support member, at the upper end, is an electric motor 47 (shown in FIG. 6) which is used to rotate a threaded lead screw 48. The lead screw 48 passes through a support bearing 49 within the support member. The lead screw is threadedly engaged with a threaded portion of a drive member 50 within the support member, which is engaged with the collar 28. As the lead screw 48 is rotated by the motor 47, the drive member 50 moves upwardly within the support member and pushes the collar 28 with it.

Figure 5:
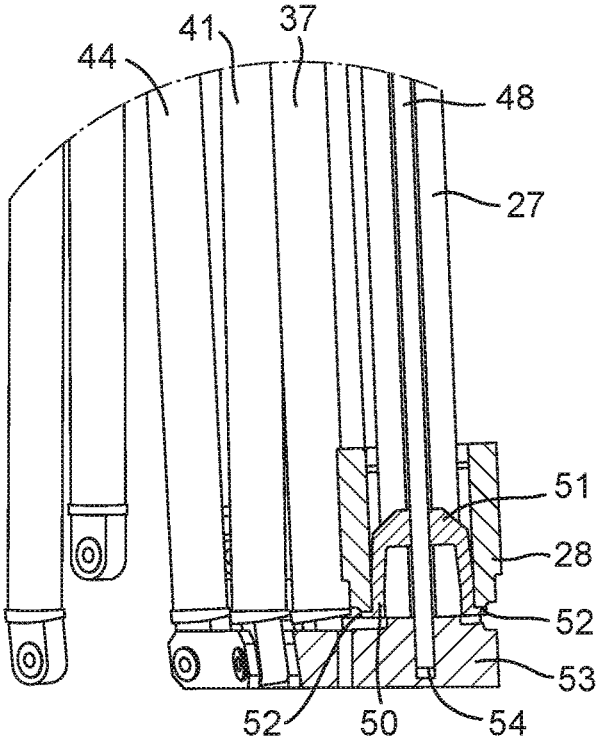
FIG. 5 is an enlarged view of the portion marked B in FIG. 3.

The arrangement is shown in more detail in FIG. 5. The drive member 50 has a central body portion 51 with a threaded bore which receive the drive shaft 48. The drive member has, on diametrically opposed sides, laterally directed lugs 52 which engage the underneath of the collar 28. The lower end of the support member 27 is provided with a base 53 having a central aperture 54 serving as a bearing for the end of the lead screw 48.

Figure 8:
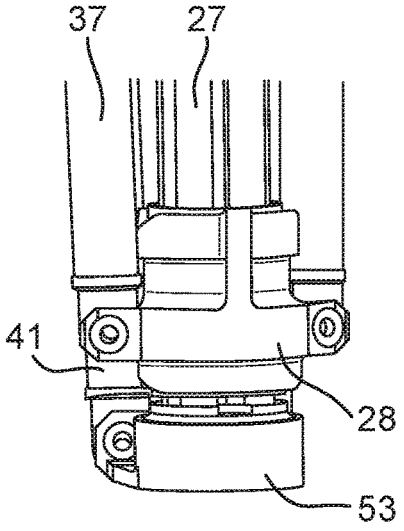
FIG. 8 is an enlarged view of the bottom of a support member.
Figure 6:
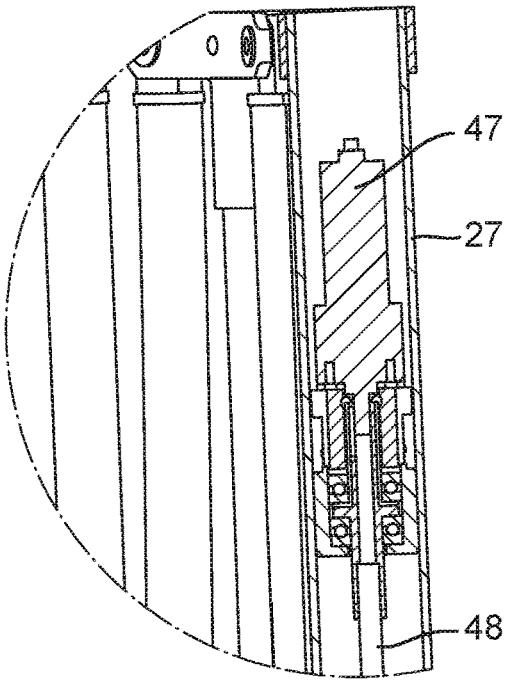
FIG. 6 is an enlarged view of the portion marked C in FIG. 3.
Figure 7:
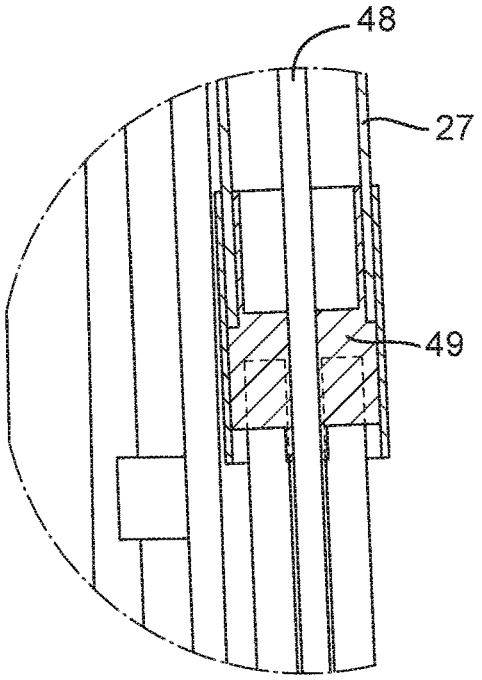
FIG. 7 is an enlarged view of the portion marked D in FIG. 3.
Figure 9:
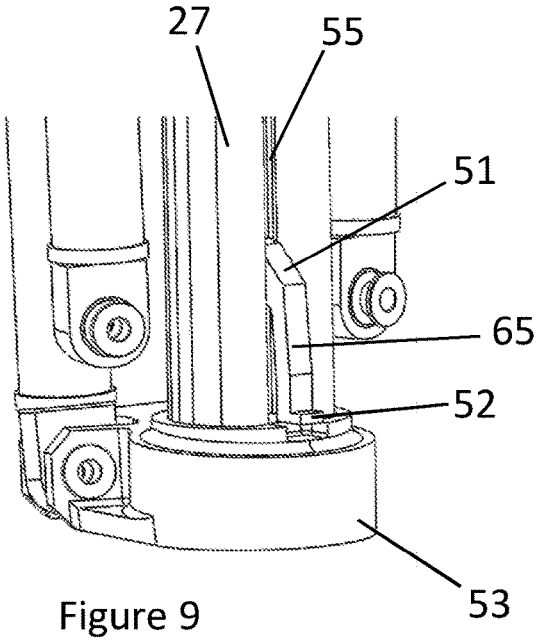
FIG. 9 is a view corresponding to FIG. 8, with the collar removed to reveal some of the drive member.
Figure 10:
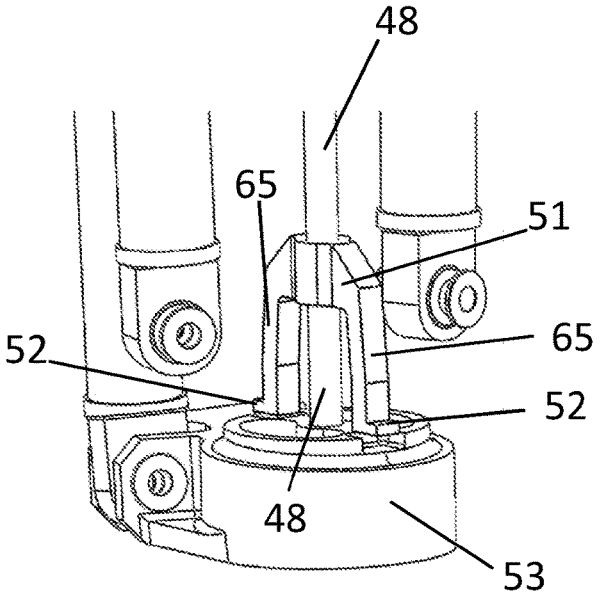
FIG. 10 is a view corresponding to FIG. 9, with the body of the support member removed.

FIG. 6 shows the motor 47 in more detail and FIG. 7 shows the bearing 49 in more detail. FIG. 8 is an enlarged view of the lower end of the support member 27. As can be seen more clearly in FIGS. 9 and 10, the main body 51 of the drive member has portions which 65 which extend through diametrically opposed longitudinally extending slots 55 in the support member 27. The portions 65 terminate in the laterally directed lugs 52.

Figure 11:
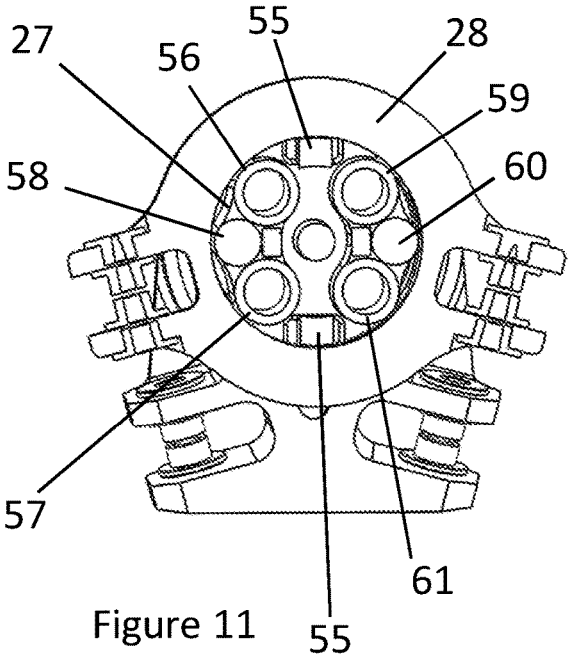
FIG. 11 is a cross section through the collar mounted on the support member.

As shown in FIG. 11, the support member 27 comprises a first group of members in the form of hollow tubes 56 and 57 either side of a rod 58; and a second group of members in the form of hollow tubes 59 and 60 either side of a rod 61. These members provide surfaces on which the collar 28 can run. The two groups of members are displaced laterally so that there are gaps between them which provide the slots 55.

Figures 12, 13:
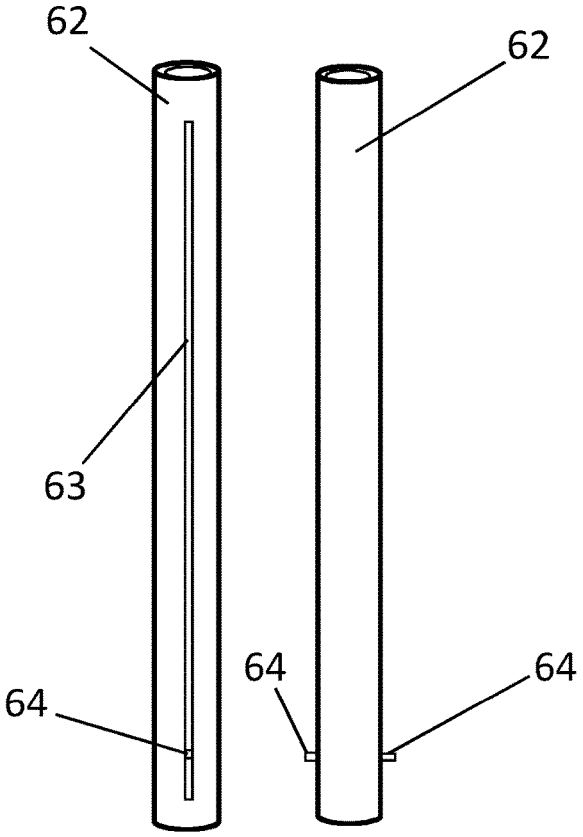
FIG. 12 is a diagrammatic view of an alternative from of support member containing a drive member.
FIG. 13 is a side view of the assembly of FIG. 12.

FIGS. 12 and 13 show in diagrammatic form an alternative support member 62 to be used in place of support member 27, in the form of a hollow tube, for example of carbon fibre. This has a pair of diametrically opposed longitudinal slots 63. Within the tube is a drive mechanism which includes a drive member having two projections 64 which extend through the slots 63 to engage a collar such as 28 described earlier.

Where pivotal connections are provided for various components, these may use low friction bushings.

The invention claimed is:

1. An actuating support member for use in a deployable structure that comprises a plurality of interconnected elongate support members of which the actuating support member is one of the elongate support members, the deployable structure being deployable from a stowed state to a deployed, expanded state in which the elongate support members are arranged in a ring; each elongate support member being provided with a connector mounted on the elongate support member and configured for longitudinal movement with respect to the elongate support member when the deployable structure is being changed between the stowed state and the expanded state;

wherein the actuating support member comprises a drive member configured for longitudinal movement with respect to a remainder of the actuating support member, and an electromechanical device arranged to drive the drive member in one direction with respect to the remainder of the actuating support member; the drive member being connected to the connector by a lost motion connection so that the drive member causes the connector to move in said one direction when the drive member is moved by the electromechanical device in said one direction, and wherein the drive member and the connector are arranged to detach from each other such that the connector is moved in said one direction even if the drive member is not moved by the electromechanical device; and wherein the lost motion connection between the drive member and the connector is provided by a portion of the drive member abutting against a portion of the connector.

2. The actuating support member as claimed in claim 1, wherein the connector is able to be separated from the drive member at any point along a length of travel of the drive member when the deployable structure is being deployed from its stowed state to its deployed state.

3. The actuating support member as claimed in claim 1, wherein the connector is able to be separated from the drive member whenever the drive member is not moved in the one direction by the electromechanical device.

4. The actuating support member as claimed in claim 1, wherein the actuating support member comprises a hollow portion, and at least part of the drive member and/or the electromechanical device is contained within the hollow portion of the actuating support member.

5. The actuating support member as claimed in claim 4, wherein the electromechanical device is arranged to rotate an elongate drive shaft extending longitudinally inside the actuating support member.

6. The actuating support member as claimed in claim 5, wherein the electromechanical device is contained at least partly within the hollow portion of the actuating support member.

7. The actuating support member as claimed in claim 5, wherein the drive shaft is in the form of a lead screw which engages a threaded portion of the drive member, so that rotation of the lead screw causes longitudinal movement of the drive member.

8. The actuating support member as claimed in claim 1, wherein the connector comprises a collar mounted on an exterior of the actuating support member.

9. The actuating support member as claimed in claim 8, wherein the actuating support member comprises at least one longitudinally extending slot that permits establishment of a connection between the drive member and the collar.

10. The actuating support member as claimed in claim 9, wherein at least one projection of the drive member extends through the at least one longitudinally extending slot and abuts against a portion of the collar.

11. The actuating support member as claimed in claim 10, wherein the at least one longitudinally extending slot comprises diametrically opposed first and second longitudinally extending slots, and the at least one projection of the drive member comprises first and second projections, with the first projection extending through the first longitudinally extending slot and the second projection extending through the second longitudinally extending slot.

12. An actuating support member for use in a deployable structure that comprises a plurality of interconnected elongate support members of which the actuating support member is one of the elongate support members, the deployable structure being deployable from a stowed state to a deployed, expanded state in which the elongate support members are arranged in a ring; each elongate support member being provided with a connector mounted on the elongate support member and configured for longitudinal movement with respect to the elongate support member when the deployable structure is being changed between the stowed state and the expanded state;

wherein the actuating support member comprises a hollow portion;

a connector comprising a collar is mounted on an exterior of the actuating support member and configured for longitudinal movement with respect to the actuating support member when the deployable structure is being changed between the stowed state and the expanded state;

the actuating support member comprises two longitudinally extending slots that provide communication between an interior of the actuating support member and the exterior of the actuating support member;

an electromechanical device is mounted in the interior of the actuating support member and is configured to turn a drive shaft that extends longitudinally in the interior of the actuating support member;

the drive shaft is connected to a drive member provided in the interior of the actuating support member, so that rotation of the drive shaft causes longitudinal movement of the drive member within the actuating support member; and connecting portions extend through the longitudinally extending slots to provide a lost motion connection between the drive member and the collar, such that movement of the drive member in one direction with respect to the actuating support member urges the collar in said one direction, and movement of the collar in said one direction is effected even if the drive member remains stationary.

13. A deployable structure comprising a plurality of interconnected elongate support members, the deployable structure being deployable from a stowed state to a deployed, expanded state in which the elongate support members are arranged in a ring; each elongate support member being provided with a connector mounted on the elongate support member for longitudinal movement with respect to the elongate support member when the deployable structure is being changed between the stowed state and the expanded state;

wherein at least one of the elongate support members comprises an actuating support member that comprises a drive member configured for longitudinal movement with respect to a remainder of the actuating support member, and an electromechanical device arranged to drive the drive member in one direction with respect to the remainder of the actuating support member; the drive member being connected to the connector by a lost motion connection so that the drive member causes the connector to move in said one direction when the drive member is moved by the electromechanical device in said one direction, and the connector is moved in said one direction even if the drive member is not moved by the electromechanical device; and wherein the actuating support member is configured to deploy the deployable structure from the stowed state to the deployed state.

14. The deployable structure as claimed in claim 13, wherein the deployable structure comprises a plurality of actuating support members, wherein plurality of actuating support members are arranged such that if a drive member of one actuating support member remains stationary, at least one other actuating support member of the plurality of actuating support members is capable of operating to deploy the deployable structure owing to the lost motion connection between the drive member remaining stationary and its associated connector.

15. The deployable structure as claimed in claim 14, wherein the at least one other actuating support member is arranged to actuate the connector associated with the drive member remaining stationary in said one direction even if the drive member remaining stationary is not moved by the electromechanical device.

* * * * *